United States Patent [19]

Flannery

[11] 4,290,598

[45] Sep. 22, 1981

[54] TENSION EXERCISER

[76] Inventor: Matt W. Flannery, 310 Berry Ave., Westwood, Ashland, Ky. 41101

[21] Appl. No.: 127,256

[22] Filed: Mar. 4, 1980

[51] Int. Cl.[3] ..... A63B 21/06

[52] U.S. Cl. ..... 272/117

[58] Field of Search ..... 272/116–119, 272/126, 134, 143, 144, 136; 294/74, 81 R

[56] References Cited

U.S. PATENT DOCUMENTS

| | | | |
|---|---|---|---|
| 232,022 | 9/1880 | Gifford et al. | 272/117 |
| 404,802 | 6/1889 | Sleeper | 272/118 |
| 426,249 | 4/1890 | Dowd | 272/117 |
| 435,180 | 8/1890 | Howe | 272/117 |
| 448,305 | 3/1891 | Thayer | 272/117 |
| 1,253,885 | 1/1918 | Quinones | 272/117 X |
| 3,117,782 | 1/1964 | Johnston | 272/144 X |
| 3,343,862 | 9/1967 | Holmes | 294/81 R X |
| 3,708,167 | 1/1973 | Potgieter | 272/117 |
| 3,861,675 | 1/1975 | Hopper | 272/117 X |
| 4,084,815 | 4/1978 | Flannery | 272/117 X |
| 4,185,862 | 1/1980 | Slocombe | 294/74 |
| 4,243,219 | 1/1981 | Price | 272/117 |

FOREIGN PATENT DOCUMENTS

| | | | |
|---|---|---|---|
| 1122390 | 1/1962 | Fed. Rep. of Germany | 294/81 R |
| 1192960 | 5/1965 | Fed. Rep. of Germany | 272/126 |
| 203283 | 6/1939 | Switzerland | 294/74 |

*Primary Examiner*—Richard J. Apley
*Attorney, Agent, or Firm*—Harvey B. Jacobson

[57] ABSTRACT

A weight assembly for an exercising apparatus is provided and includes a pair of vertically spaced superposed upper and lower generally horizontal panel members each including four openings formed therethrough spaced about a central area of the panel member. The two sets of four openings are at least generally registered and four upstanding elongated flexible tension member sections have their lower ends slidably received through corresponding openings in the panel members and the lower terminal ends of the tension member sections are anchored through the openings in the lower panel member. The upper ends of the tension members are upwardly convergent and are anchored relative to an anchor member. Variable weight value structure is supported on the lower panel member below the upper panel member and the tensioning of the tension member sections and the weight of the upper panel member tend to cause the variable weight value structure to be clamped between the upper and lower panel members. Further, novel structure is provided for anchoring the tension member sections to the anchor member and the latter to a pair of tension member sections trained over a pair of pulleys.

9 Claims, 12 Drawing Figures

TENSION EXERCISER

BACKGROUND OF THE INVENTION

Various forms of tension exercisers have been heretofore designed, but most of these have not been particularly well adapted to enable varied exercising of different body limb portions. Although an effective tension exerciser is disclosed in my prior U.S. Pat. No. 4,084,815, even this exerciser does not include structure whereby different weight value weight structure may be readily operatively associated with the exerciser. In addition, my above-noted prior patent discloses tension member anchoring structure which is expensive to produce and thereby unnecessarily increases the cost of manufacture. Accordingly, a need exists for a tension exerciser including structure whereby different value weight structure may be readily utilized in conjunction with the exerciser and the various tension member sections of the exerciser may be anchored relative to each other in an inexpensive manner.

In addition to the exerciser disclosed in my above-noted prior patent, other similar exercising devices are disclosed in U.S. Pat. Nos. 2,183,265, 2,716,027, 3,117,782, 3,162,441, 3,752,474, 3,834,694 and 3,858,874. Further, additional similar exercising devices are also disclosed in French Pat. No. 1,183,144 and Swedish Pat. Nos. 78,676.

BRIEF DESCRIPTION OF THE INVENTION

The tension exerciser of the instant invention includes novel structure whereby the weight assembly thereof may have its weight value readily varied as desired. In addition, the exerciser is so constructed whereby only a few components thereof need be manufactured and packaged for marketing with the remaining components thereof being readily obtainable locally by the purchaser of the apparatus. Thus, the inital cost of the exerciser is greatly reduced and the purchaser may enjoy obtaining and assembling the remaining components of the exerciser at a minimum cost.

The main object of this invention is to provide an exerciser constructed in a manner whereby only a few premanufactured components thereof need be marketed with the remaining components of the exerciser being readily locally obtainable by the ultimate purchaser of the exerciser.

A further object of this invention is to provide an exerciser which may be used in a controlled manner to simultaneously exercise a pair of limbs of the user and for exercising two pairs of limbs simultaneously, if desired.

Still another important object of this invention is to provide an exerciser which will enable the two limbs being exercised to be exercised in opposition relative to each other.

A further object of this invention is to provide an exerciser including structure whereby movement of the two limbs being exercised may be opposed by adjustable weight loading in one direction of movement thereof.

Still another object of this invention is to provide an exerciser constructed in a manner whereby it may be utilized in a home environment.

A final object of this invention to be specifically enumerated herein is to provide an exerciser which will conform to conventional forms of manufacture, be of simple construction and easy to use, so as to provide a device that will be economically feasible long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
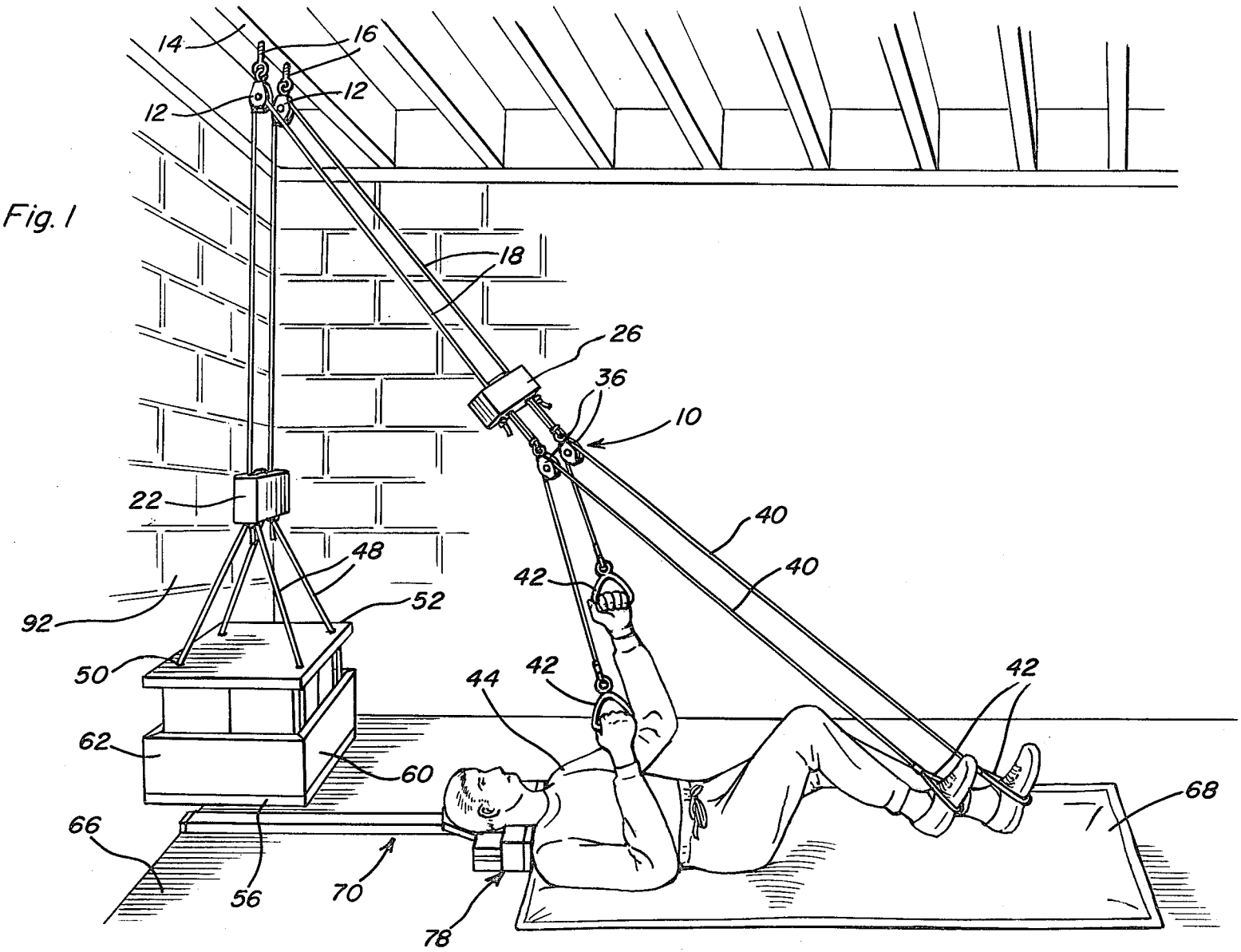
FIG. 1 is a perspective view of the exerciser of the instant invention.
Figure 2:
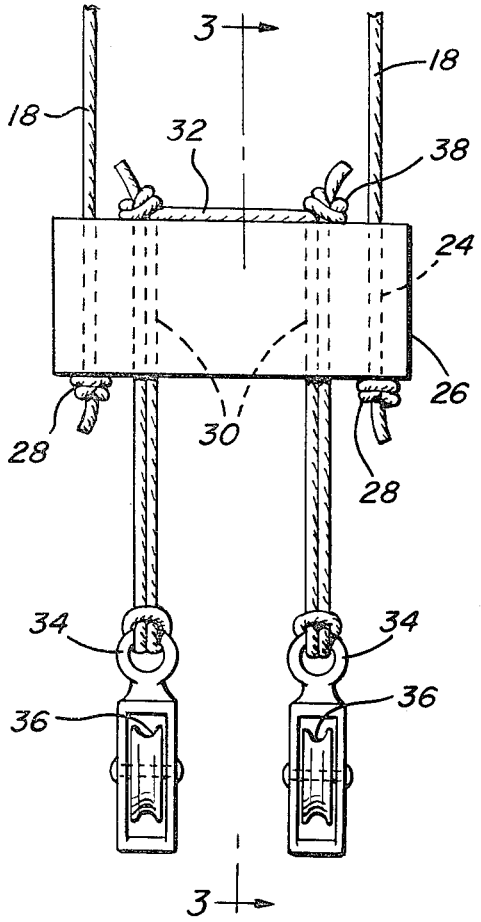
FIG. 2 is a fragmentary, elevational view illustrating one of the anchoring structures of the invention utilized to anchor the limb exercising ropes of the exerciser to the weight suspension ropes of the exerciser.
Figure 3:
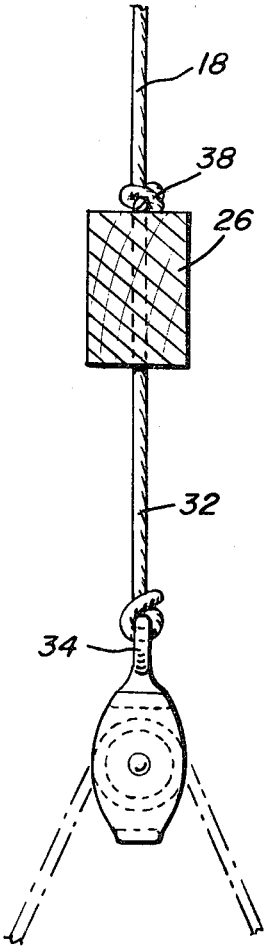
FIG. 3 is a sectional view taken substantially upon the plane indicated by the section line 3—3 of FIG. 2.
Figure 5:
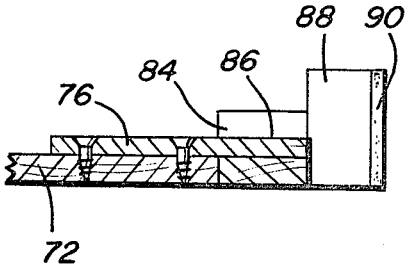
FIG. 5 is an enlarged, fragmentary, vertical, sectional view taken substantially upon the plane indicated by the section line 5—5 of FIG. 4.
Figure 6:
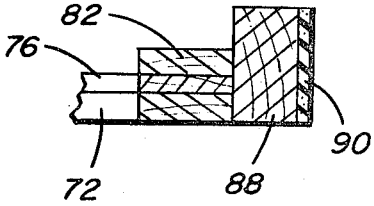
FIG. 6 is an enlarged, vertical, sectional view taken substantially upon the plane indicated by the section line 6—6 of FIG. 4.
Figure 4:
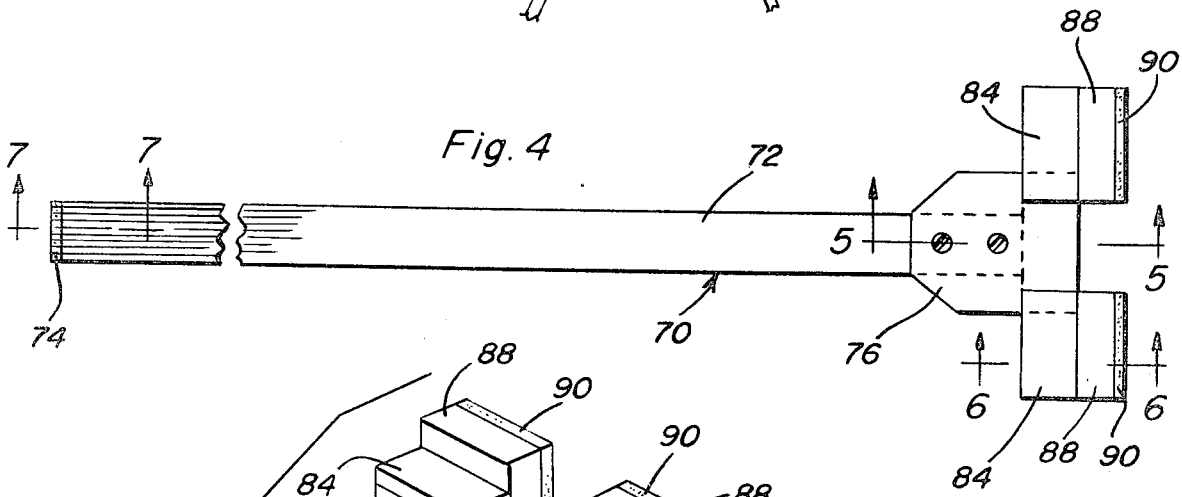
FIG. 4 is a top plan view of a user positioning maintaining accessory of the exerciser.
Figure 8:
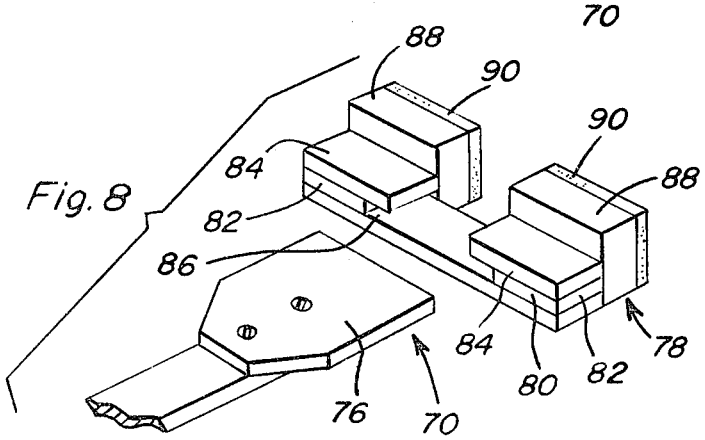
FIG. 8 is a fragmentary, exploded, perspective view of the head portion of the user position maintaining structure illustrated in FIG. 4.
Figure 7:
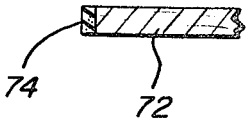
FIG. 7 is an enlarged, fragmentary, vertical, sectional view taken substantially upon the plane indicated by the section line 7—7 of FIG. 4.
Figure 9:
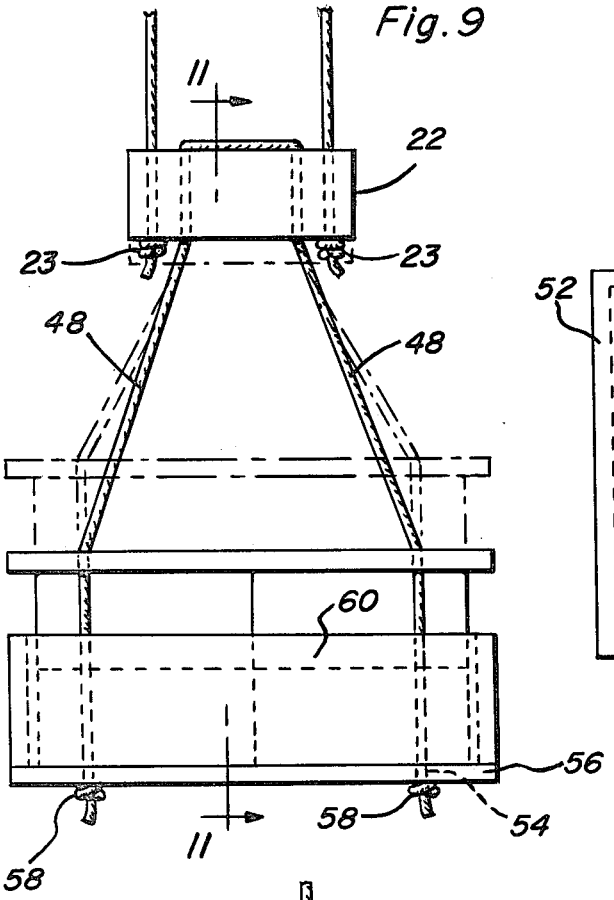
FIG. 9 is an elevational view of the variable weight value weight structure of the instant invention.
Figure 10:
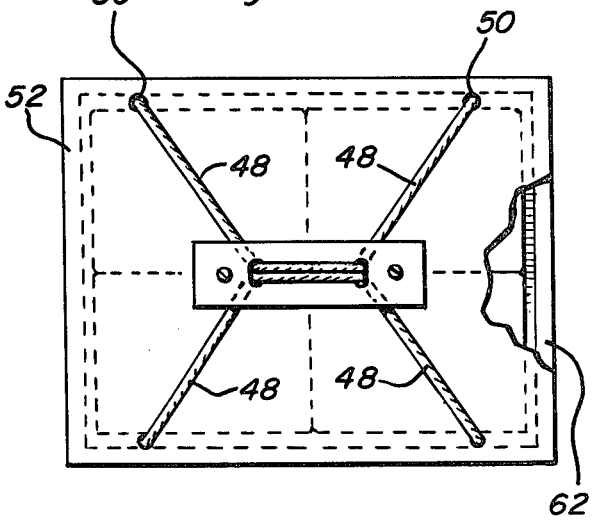
FIG. 10 is a top plan view of the assemblage illustrated in FIG. 9.
Figure 11:
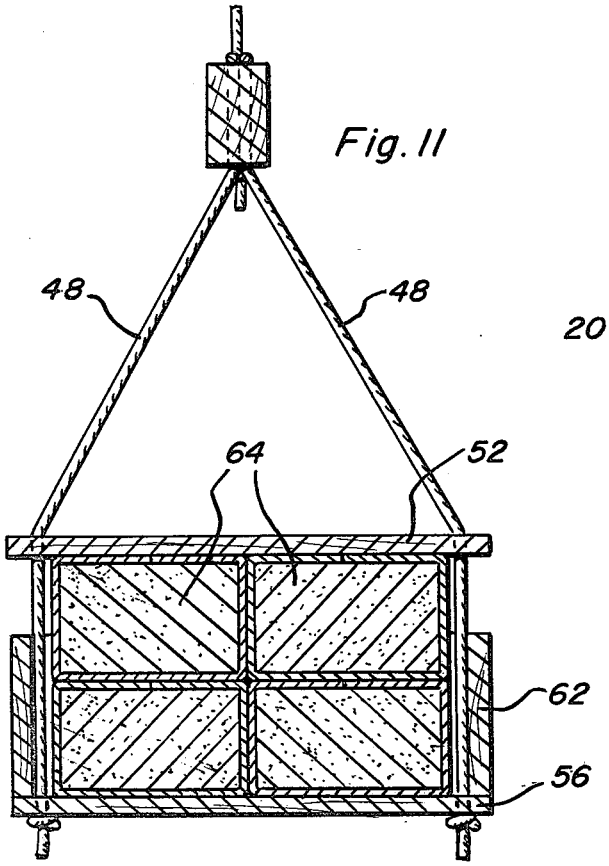
FIG. 11 is a vertical, sectional view taken substantially upon the plane indicated by the section line 11—11 of FIG. 9.
Figure 12:
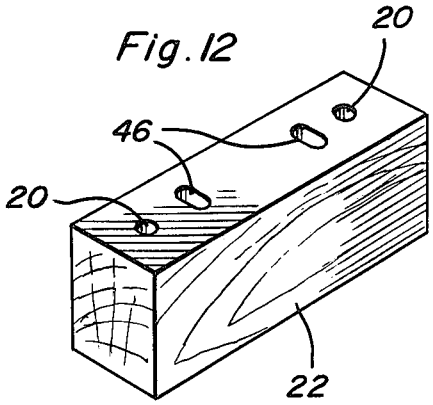
FIG. 12 is a perspective view of the anchor block portion of the assemblage illustrated in FIGS. 9, 10 and 11.

Referring now more specifically to FIG. 1 of the drawings, the numeral 10 generally designates the tension exerciser of the instant invention. The exerciser 10 includes a pair of main support pulleys 12 suspended from a ceiling beam 14 through the utilization of eye hooks 16 and a pair of flexible tension members 18 are trained over the pulleys 12 with one depending set of end portions of the tension members 18 passed downwardly and anchored through a pair of opposite end vertical bores 20 formed in a horizontal anchor block 22 by knots 23. The terminal ends of the other inclined end portions of the tension members 18 are passed downwardly through similar bores 24 formed in a second anchor block 26 and secured through the bores 24 by knots 28. The anchor block 26 additionally includes a second pair of upstanding bores 30 formed therethrough and a single tension member 32 has its midportion spanning between the upper ends of the bores 30 and its opposite end portions passed downwardly through the bores 30, looped through attaching rings 34 on a pair of depending pulleys 36 and passed back upwardly through the same bores 30 and secured therethrough by knots 38. A pair of elongated tension members 40 have their midportions trained over the pulleys 36 and the opposite ends of the tension members include body limb engageable loops 42 which may be engaged by the hands and feet of the user 44 of the exerciser 10.

The anchor block 22 being similar to the anchor block 26 also includes a second pair of vertical bores 46 formed therethough and the midportions of a pair of tension member 48 extend between the bores 46 and the opposite end portions of the tension members 48 passing downwardly through the bores 46, slidably received through four corner bores 50 formed in an upper panel member 52 and also slidably received through similar corner bores 54 formed in a lower panel member 56, the lower terminal ends of the tension members 48 being anchored through the bores 54 in the lower panel member 56 by knots 58.

The lower panel member 56 defines the bottom of an upwardly opening receptacle including opposite side and end walls 60 and 62 and suitable weight structures and stacked within the receptacle. The upper panel member 52 is freely slidable on the tension members 48 and the tension members 48 are upwardly convergent from the upper panel member 52 whereby the weight of the upper panel member 52 and the incline of the upper portions of the tension members 48 above the panel member 52 tends to bias the latter downwardly into clamping engagement with the weight structures 64 contained within the receptacle defined by the lower panel member 56 and the opposite side and end walls 60 and 62. Of course, when the entire weight assembly comprising all of the structure dependingly supported from the anchor block 22 rests upon a suitable horizontal surface such as the floor 66, the upper panel member 52 may be readily raised relative to the tension members 48 in order to provide access to the weight structures 64 so that the combined weight thereof may be reduced or increased, as desired.

It may be seen from FIG. 1 of the drawings that the user 44 rests upon a suitable pad 68 disposed on the floor 66 and that a positioning prop assembly referred to in general by the reference numeral 70 is provided to prevent the user 44 from sliding toward the vertical path in which the weight assembly may be vertically reciprocated.

The prop assembly 70 includes an elongated bar member 72 provided with a resilient foot portion 74 at one end and including a transverse panel-like head 76 secured to the upper surface of its other end portion. An abutment block assembly referred to in general by the reference numeral 78 comprises a part of the prop assembly 70 and includes a base plate 80 including opposite end spacing and keeper blocks 82 and 84 defining a recess 86 in which the panel-like head 76 is seatingly receivable, the end of the recess 86 remote from the foot portion 74 being closed by a pair of shoulder blocks 88 anchored relative to the blocks 82 and 84 and padded as at 90. From FIG. 1 of the drawings it may be seen that the prop assembly may be used to engage the shoulders of the user 44 in order to prevent movement of the user 44 toward the wall 92 vertically along which the weight assembly is movable.

It will be noted that the tension exerciser may be marketed in abbreviated form including only the tension members 40, together with their ring members 42, the pulleys 12 and 36, the anchor eyes 16 and the tension members 18, 32 and 48. The prop assembly 70 is not to be considered as a critical portion of the exerciser 10, but merely as an accessory therefor and the anchor blocks 22 and 26 as well as the panel members 52 and 56 and also the side and end walls 60 and 62 may be separately purchased in order to assembly the exerciser 10.

The exerciser 10 is fully operative in the manner of the exerciser disclosed in my prior U.S. Pat. No. 4,084,815, but may be more economically manufactured and marketed. Further, the utilization of pairs of tension members 48, 18 and 32 insures safe operation of the exerciser, even though extended usage over a long period of time may cause one set of tension members to become frayed and weakened.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a horizontal first structure and a second structure elevated above said first structure, pulley means in anchored relation to said second structure, abutment means on said first structure spaced normal from an upstanding plane containing said pulley means and against which a person disposed on said first structure may abut at least one portion of his body to prevent sliding of said person relative to said first structure toward said plane, first elongated flexible tension member means having its midportion passed over said pulley means, a first end portion depending downwardly from said pulley means and a second end portion extending downwardly from said pulley means toward said first structure at an incline away from said plane, gravity weight means of predetermined selected value supported from a lower portion of said first end portion, anchor means supported from a lower portion of said second end portion, a pulley assembly supported from said anchor means, second elongated flexible tension member means having its longitudinal midportion guidingly engaged over said pulley assembly and including opposite end body limb engageable portions for engagement by arm and/or leg limbs with forces exerted by the limbs engaged therewith in opposition to the predetermined selected gravity weight value of said weight means supported from said lower portion of said first end portion of said first tension member means, said weight means including an anchor member to which said first end portion is anchored, a pair of superposed upper and lower generally horizontal panel members provided with four openings therethrough spaced about central areas of said panel members and with the openings in said panel members at least generally registered, four elongated upstanding flexible tension member sections having their lower ends slidingly received through corresponding openings in said panel members and anchored through the openings in the lower panel member, the upper ends of said tension member sections being upwardly convergent and anchored relative to said anchor member, and variable weight structure supported on said lower panel member and below the upper panel member.

2. The combination of claim 1 wherein said tension member sections comprise opposite end portions of a pair of tension members, said anchor member including at least two vertical bores formed therethrough, the central midportions of said tension sections passing through said bores and extending between the upper ends thereof.

3. The combination of claim 1 wherein said variable weight structure includes an upwardly opening receptacle supported on said lower panel member and weight members received in said receptacle.

4. The combination of claim 1 wherein said pulley means includes a pair of pulleys, said first tension member means comprising a pair of tension members guidingly engaged over said pulleys, said anchor member having a pair of upstanding passages formed therethrough, the lower ends of said pair of tension members comprising said depending first tension member means first end portion being passed downwardly through said passages and anchored therethrough.

5. The combination of claim 4 including anchor means to which the lower ends of said pair of tension members comprising said first tension member means and second end portion are secured, said pulley assembly comprising a pair of pulleys supported from said anchor member, said second elongated flexible tension member means comprising a pair of tension member sections having their midportions passed over the last mentioned pulleys and the opposite ends of the last mentioned tension members each having one of said body limb engageable portions anchored relative thereto.

6. In combination with an elevated support structure, first pulley means supported from said support structure, first elongated flexible tension member means guidingly engaged over said first pulley means for lengthwise back and forth shifting relative to said first pulley means and including a depending first end portion from which a gravity weight assembly is suspended, said weight assembly being of predetermined selected value, said second pulley means anchored relative to the second end of said first tension member means, second elongated flexible tension member means guidingly engaged over said second pulley means, and body limb engageable portions carried by the opposite ends of said second elongated tension member means, said body limb engageable portions being adapted to be engaged by arm/leg limbs with forces exerted by the limbs engaged therewith in opposition to the predetermined gravity weight value of said weight suspended from said first end portion of said first tension member means, said weight assembly means including an anchor member anchored relative to said depending first end portion, a pair of superposed upper and lower generally horizontal panel members provided with four openings therethrough spaced about central areas of said panel members and with the opening in said panel members at least generally registered, four elongated upstanding flexible tension member sections having their lower ends slidingly received through corresponding openings in said panel members and anchored through the openings in the lower panel member, the upper ends of said tension member sections being upwardly convergent and anchored relative to said anchor member, and variable weight structure supported on said lower panel member and below the upper panel member.

7. The combination of claim 6 wherein said first pulley means comprises a pair of pulleys, said first elongated flexible tension member means comprising a pair of tension members trained over said pulleys, said anchor member comprising a horizontally elongated structure, one pair of ends of said tension members being anchored relative to opposite ends of said horizontally elongated structure, a second horizontally elongated structure to whose opposite ends the other pair of ends of said tension members are anchored, said second pulley means comprising a second pair of pulleys anchored relative to the opposite ends of said second horizontally elongated structure, said second elongated flexible tension member means comprising a second pair of tension members whose midportions are guidingly engaged over said second pulleys, the opposite ends of said second tension members each having a body limb engageable portion carried thereby.

8. The combination of claim 7 wherein said second horizontally elongated structure includes a pair of upstanding bores formed through its opposite end portions, said second pair of ends of said first tension members being passed and secured through said bores.

9. The combination of claim 6 wherein said elevated support structure comprises a building ceiling structure adjacent one wall of the building along which said gravity weight is vertically movable, an elongated prop assembly including one end for abutting said wall and a second end defining spaced shoulder pad portions against which the shoulders of the user may be abutted to prevent sliding of the user toward the wall when the user is lying upon his back.

* * * * *